United States Patent [19]

Booth

[11] 4,004,745

[45] Jan. 25, 1977

[54] YARN DISPENSING APPARATUS

[76] Inventor: Jacqueline L. Booth, Box 21, Bayview, Idaho 83803

[22] Filed: June 18, 1975

[21] Appl. No.: 587,913

[52] U.S. Cl. ..... 242/54 R; 242/127; 242/129

[51] Int. Cl.[2] ..... B65H 75/00; B65H 49/30

[58] Field of Search ..... 242/54 R, 127–146, 242/166–171, 78; 57/106, 108; 200/86.5

[56] References Cited

UNITED STATES PATENTS

| | | | |
|---|---|---|---|
| 434,279 | 8/1890 | Key | 242/137.1 |
| 712,874 | 11/1902 | West | 242/127 |
| 1,093,390 | 4/1914 | Foster | 242/54 R |
| 1,823,083 | 9/1931 | Brown | 200/86.5 |
| 2,100,388 | 11/1937 | Fisher | 242/166 |
| 2,314,619 | 3/1943 | Hess | 242/127 X |
| 2,424,413 | 7/1947 | Nelson | 242/54 R |
| 2,424,529 | 7/1947 | Wimmer | 200/86.5 |
| 2,855,164 | 10/1958 | Hirschman | 242/171 |
| 3,018,067 | 1/1962 | Vandervoort | 242/137 |
| 3,199,805 | 8/1965 | Kohn et al. | 242/78 |
| 3,309,040 | 3/1967 | Stancil | 242/139 |

*Primary Examiner*—Leonard D. Christian
*Attorney, Agent, or Firm*—Wells, St. John & Roberts

[57] ABSTRACT

A knitting and crocheting aid is described for use when two or more strands of yarn or thread are to be knitted or crocheted together. The device includes an upwardly open container. The container is mounted to a base for rotational movement about a vertical axis. A foot treadle is included that actuates a drive mechanism in the base for rotating the container in a clockwise motion about the vertical axis. Several skeins of thread or yarn are held within the container with their loose ends protruding upwardly through a flexible fabric covering at the top of the container. When the strands become twisted together due to the knitting or crocheting action, the treadle may be operated to turn the container and the skeins held therein to untwist the yarn. The flexible covering includes a drawstring that enables opening and closing of the covering to allow access to the container interior and to enable closure of the cover against strands of the skeins protruding from the container.

3 Claims, 3 Drawing Figures

FIG 1
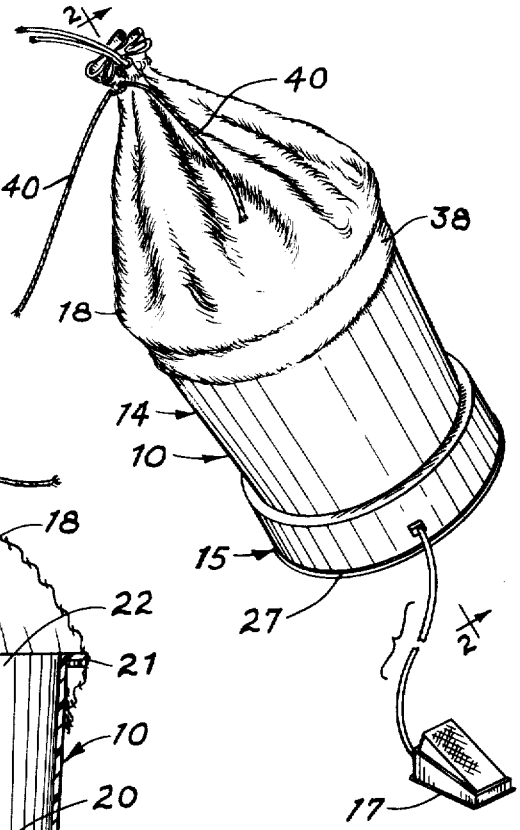
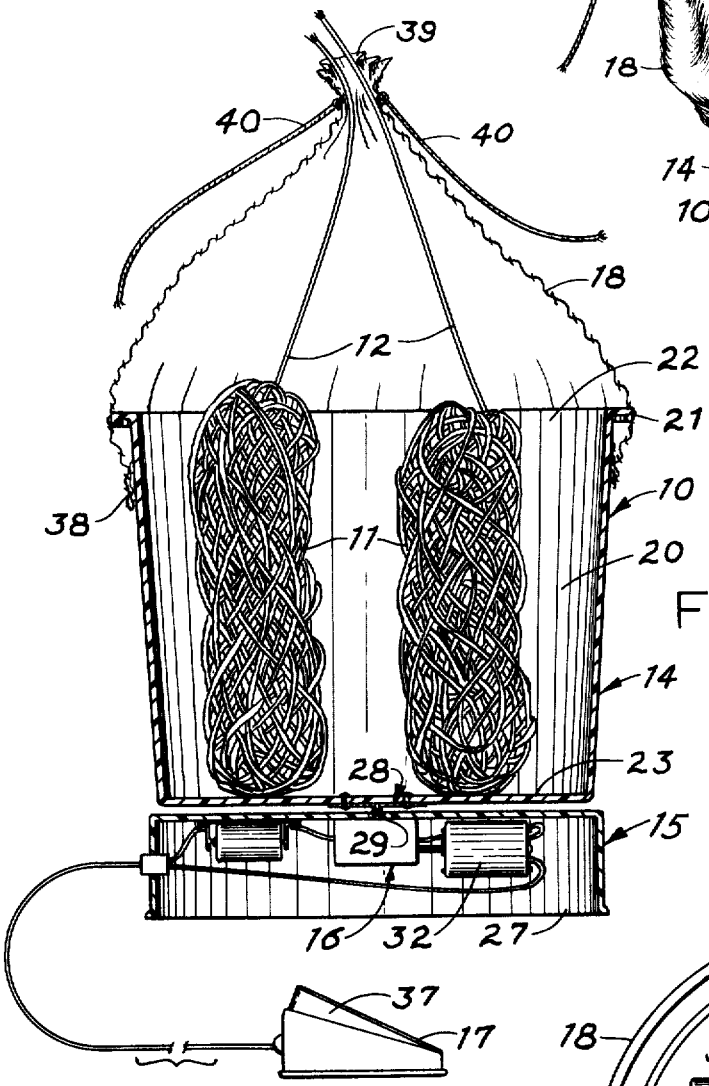
FIG 2
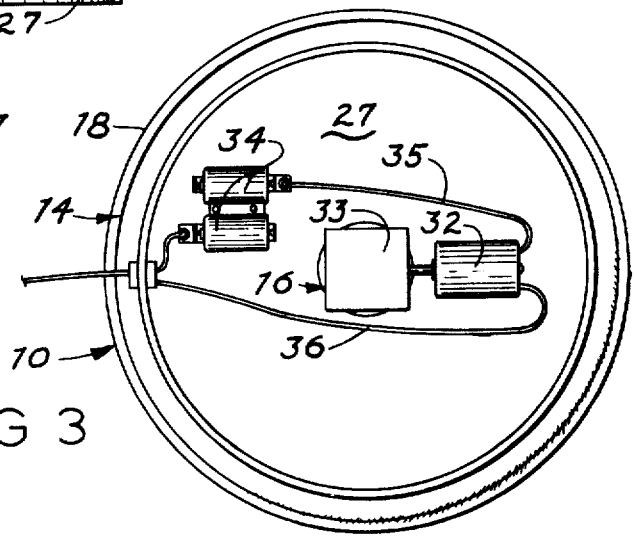
FIG 3

YARN DISPENSING APPARATUS

BACKGROUND OF THE INVENTION

The present invention is related to knitting accessories and more particularly to devices to aid in knitting and crocheting.

When two or more skeins of yarn are utilized at one time to make a knitted or crocheted pattern, the yarn strands between the hook or needles and the skeins often become twisted together due to the knitting or crocheting process. When this happens, either the skeins or the pattern must be rotated to unwind the twisted strands. This is tedious procedure and takes much of the enjoyment from the hobby.

U.S. Pat. No. 2,100,388 discloses a holder and method for knitting, crocheting and analagous purposes. The holder is comprised of a rectangular box that is convertible to hold a conically shaped wound skein of knitting or crocheting material. A separate lower compartment holds a second skein of material with its free end being drawn through an open reduced end of the cone. Although the device and method described are for utilization with one or more skeins, no provision is shown for unwinding the yarn strands once they become twisted during the knitting or crocheting operation.

U.S. Pat. No. 2,855,164 discloses a knitting thread holder. With this device, a loose skein is utilized along with a separate skein held within a tubular container. A strand from the loose skein is drawn through a central opening within the tubular container while yarn from the skein held within the container is fed directly from the skein to be combined with the yarn from the loose skein. FIG. 3 of the drawings shows the particular twisted arrangement that is desired with this device. However, no apparatus or method is disclosed for unwinding the two separate yarns from such a condition.

It is one object of the present invention to provide a crocheting and knitting aid that enables selective untwisting of two or more strands of yarn.

An additional object is to provide such an aid that will accomplish the untwisting motion automatically without distracting the user from knitting or crocheting operations.

These and further objects and advantages will become apparent upon reading the following description which, taken with the accompanying drawings, disclose a preferred form of the present invention.

BRIEF DESCRIPTION OF THE DRAWINGS

A preferred form of the present invention is illustrated in the accompanying drawings in which:

FIG. 1 is a pictorial view of the present knitting and crocheting aid;

FIG. 2 is an enlarged vertical sectioned view taken substantially along 2—2 in FIG. 1; and FIG. 3 is an enlarged bottom plan view of the aid.

DETAILED DESCRIPTION OF A PREFERRED EMBODIMENT

A preferred form of the present knitting and crocheting aid is illustrated in the accompanying drawings and is designated therein by the reference character 10. Basically, the device is utilized to receive a plurality of skeins 11 (FIG. 2) formed of yarn or thread 12. The device operates to rotate the skeins 11 about a common axis in order to untwist or to twist the individual strands of yarn extending from each skein.

The aid is comprised of an upwardly open container 14 that is supported by a base 15. The container is driven to rotate about a fixed vertical axis by a drive means 16. A treadle switch 17 is utilized for foot control of the aid 10. A user may thus selectively rotate the container and the skeins held therein simply by depressing the treadle 17. A cover material 18 is provided about the open upward end of the container 14. The cover is flexible and may be gathered at its upper edge to enclose the container and skeins held therein.

Looking in particular detail to FIG. 2, the container 14 is shown including upright walls 20. Walls 20 include upward flanged ends 21 that define an upwardly facing circular opening 22. The lower end of the container includes a horizontal bottom 23 that joins walls 20 together.

The base 10 includes a housing 27 that supports the container 14 through an intermediate mounting means 28. Means 28 may be simply comprised of an upright post 29 fixed to the bottom horizontal wall 23 and rotatably supported by housing 27. The mounting means 28 enables rotation of the container 14 about a fixed vertical axis relative to the base 15.

The drive means 16 as shown in FIGS. 2 and 3 is comprised of a small electric motor 32 connected to a transmission assembly 33. The transmission is, in turn connected to the mounting means 28. Motor 32 may be operated by ordinary dry cell batteries 34 and other provisions such as a conventional rectifier or transformer (not shown) may be used to adapt the motor and transmission to alternating household current. The batteries 34 are inter-connected by a lead wire 35 with a second lead wire 36 extending from the motor directly to the treadle switch 17.

The motor 32 and transmission 33 are designed to impart a clockwise rotation to the container 10. This direction is preferred since most knitting and crocheting processes produce a counter-clockwise twist in the yarn or fabric. So, to untwist the yarn, a clockwise movement of the skeins is necessary.

Treadle switch 17 may be of a conventional form wherein depression of a peddle 37 thereon makes contact to complete the circuit through the batteries 34 to activate motor 32. It is preferable that the transmission 33 be adapted, along with the motor and batteries, to operate at an output R.P.M. range of between 35 and 45 R.P.M.

The cover 18 is preferably formed of a fabric material and includes a bottom end 38 that is affixed as with glue or other fastening means to the outer periphial surface of the upright walls 20 adjacent flanged end 21. An upward edge 39 of the cover material 18 is folded to include drawstrings 40. Drawstrings 40 may be selectively pulled to gather the upper edge 39 about drawstring 40 as shown in FIGS. 1 and 2, or the edge may be separated to allow access to the container interior.

From the above description, operation of the present invention may now be easily understood. Before beginning knitting, the user first places the desired number of skeins 11 within the container 14. The loose yarn ends 12 from each skein are then pulled upwardly through the open end. The drawstrings 40 are then pulled to close the upper cover edge 39 about the exposed yarn strands. The user may then begin to knit or crochet while gradually pulling the yarn 12 from the container. The closed cover 18 prevents the skeins 11 from pulling out of the container.

If desired, the individual yarns 12 may be twisted in a desired manner simply by depressing the treadle switch 17 and holding the loose ends of the yarn stationary. The rotating container 14 thereby serves to twist the strands together.

If no twist is desired, the user simply continues knitting or crocheting until, through the knitting or crocheting process, the yarn becomes twisted. When it becomes desirable to untwist the yarns 12, the user simply again depresses the treadle switch 17 to cause clockwise rotation of the container 14. Ordinarily, a clockwise rotation will remove the twist produced through a normal knitting or crocheting operation. When the yarns become untwisted, the user simply breaks the electrical circuit to motor 32 by releasing downward pressure against the treadle switch 17.

It should be noted that the complete operation of the present aid 10 is accomplished without requiring the use of the hands. Therefore, the user may continue knitting or crocheting while simultaneously twisting or untwisting the yarns 12.

When not in use, the aid may serve additionally as a knitting basket for storage of yarn skeins, knitting needles and the like.

The above description is directed toward a preferred form of the present invention, it being understood that other embodiments may be devised without departing from the scope of the invention. Therefore, only the following claims are to be taken as definitions of this invention.

What I claim is:

1. A hand knitting or crocheting aid for holding two or more skeins of yarn or thread to enable a person to knit or crochet an object without counter-clockwise twisting the yarns or threads about each other between the skeins and the object as the object is being produced, comprising:

an upright open skein receiving container of sufficient size to receive two or more skeins having free ends in an upright orientation;

a flexible fabric covering attached to the container about an open end of the container with the fabric extending upward to an open end;

drawstring means at the upper end of the flexible fabric covering for drawing the covering open end partially closed to form a small opening for the free ends of the skeins to extend therethrough while covering the container to prevent the skein from being pulled from the container when the covering open end is partially closed;

a base member for supporting the skein receiving container in an upright orientation;

mounting means on the base member for supporting the container for rotational movement relative to the base member about a fixed axis;

drive means operatively connected to the mounting means for selectively rotating the container in a clockwise rotation about the fixed axis; and control means operatively connected to the drive means for selectively activating the drive means for rotating the container clockwise to prevent counter-clockwise twisting of the two or more threads or yarns between the skeins and the object as the object is being knitted or crocheted.

2. The aid as defined by claim 1 wherein the drive means is comprised of an electric motor and drive transmission and wherein the control means is comprised of a treadle switch, and further comprises a source of electrical energy to drive the motor.

3. The aid as defined in claim 2 wherein the drive means is operated to rotate the container at 35 to 45 R.P.M.

* * * * *